US008468629B2

(12) United States Patent
Beevers et al.

(10) Patent No.: US 8,468,629 B2
(45) Date of Patent: Jun. 25, 2013

(54) INFANT SUPPORT DEVICE

(75) Inventors: Katherine K. Beevers, McMinnville, OR (US); Timothy R. Beevers, McMinnville, OR (US)

(73) Assignee: Beevers Manufacturing & Supply, Inc., McMinnville, OR (US)

( * ) Notice: Subject to any disclaimer, the term of this patent is extended or adjusted under 35 U.S.C. 154(b) by 171 days.

(21) Appl. No.: 12/861,074

(22) Filed: Aug. 23, 2010

(65) Prior Publication Data

US 2012/0180221 A1 Jul. 19, 2012

(51) Int. Cl.
*B68G 5/00* (2006.01)

(52) U.S. Cl.
USPC ..... 5/655; 5/632; 5/630; 5/633; 5/634; 5/603

(58) Field of Classification Search
USPC ..... 5/482, 632, 630, 625, 633, 634, 924, 5/603, 655
See application file for complete search history.

(56) References Cited

U.S. PATENT DOCUMENTS

| | | | | |
|---|---|---|---|---|
| 4,410,214 | A * | 10/1983 | Geschwender | 5/633 |
| 4,941,465 | A | 7/1990 | Borschneck | |
| 5,020,854 | A * | 6/1991 | Powell | 5/419 |
| 5,360,258 | A * | 11/1994 | Alivizatos | 5/655 |
| 5,927,806 | A | 7/1999 | Ohlson | |
| 6,250,712 | B1 * | 6/2001 | Livington et al. | 5/632 |
| 6,682,137 | B2 | 1/2004 | Hsia | |
| 6,898,812 | B2 * | 5/2005 | Smart | 5/655 |
| 6,981,956 | B2 | 1/2006 | Scheinberg et al. | |
| 7,329,229 | B2 | 2/2008 | Scheinberg et al. | |
| 7,412,737 | B2 * | 8/2008 | Hernadez | 5/655 |
| 2008/0042402 | A1 * | 2/2008 | Nores | 280/644 |
| 2009/0007336 | A1 | 1/2009 | Kassai | |
| 2011/0119832 | A1 * | 5/2011 | Hung | 5/655 |

* cited by examiner

*Primary Examiner* — Robert G Santos
*Assistant Examiner* — David E Sosnowski
(74) *Attorney, Agent, or Firm* — Timothy E. Siegel Patent Law, PLLC; Timothy E. Siegel

(57) ABSTRACT

An infant holding device, including an infant holding portion, including a ductile sheet covered with infant-compatible material and a stand portion, adapted to support the infant holding portion in a vertically diagonal position, so that the infant holding portion thereby has a top and a bottom. In one preferred embodiment the ductile sheet is made of aluminum.

9 Claims, 2 Drawing Sheets

INFANT SUPPORT DEVICE

BACKGROUND

Developmental positioning aids are an important adjunct to care of the premature infant. Supporting and positioning the infant is a high priority, but people have mostly used found objects to do the job, such as blankets, pillows, towels. Many positioning aids have been developed but they have been primarily aimed at restraining movement in two-dimensions, helping to keep the baby from twisting or rolling around on the bed, for example. An exception is the use of pillows or other objects to elevate the head. To accommodate wires and tubes, these devices can be deformed or the user can place several devices around the baby with spaces between them. Unfortunately when the infant requires respiratory support this big, cuddly wall of positioning devices gets in the way of the tubing. Also the use of small, spaced devices reduces stability and complicates readjustment. Finally these materials often lose their shape over time, thereby requiring constant monitoring and adjustment.

There are two main problems with these aids. First, they tend to be solid blocks, rolls, etc. that do not naturally accommodate tubing and wires. This makes it more difficult to attach tubing and wires to the baby without potentially injuring him or her by pushing, pulling, lifting or twisting. Second, they are not adapted to hold the baby above the surface of the bed which would provide a space between the baby and the bed through which wires could be extended or to permit placing the baby at a specific, beneficial position in three dimensions and hold him or her there securely.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect the present invention may take the form of an infant holding device, including an infant holding portion, including a ductile sheet covered with infant-compatible material and a stand portion, adapted to support the infant holding portion in a vertically diagonal position, which thereby has a top and a bottom.

In a second separate aspect the present invention may take the form of a method of supporting an infant that uses an infant holding device, including a ductile sheet covered with infant-compatible material. The infant holding device is bent into a shape adapted to retain the infant and the infant is placed into the infant holding device.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced drawings. It is intended that the embodiments and figures disclosed herein are to be considered illustrative rather than restrictive.

DEFINITION

Ductile sheet: In the context of this application the term "ductile sheet" should be taken to mean a sheet of material that can be bent into a new shape by human hands and that then retains the new shape until bent again with at least an equal amount of force.

Human hands: In the above definition "human hands" means a pair of human hands having the amount of strength present in 95% of people between the ages of 15 and 75 years.

Sheet: In the above definition the word "sheet" encompasses both a solid or porous sheet of material such as metal or polymer and a thin mat of tightly woven, composite or layered material.

Infant-compatible: In the context of this application, "infant-compatible" means a material that can contact an infant without causing damage to the infant's skin. Accordingly, such a material is non-abrasive, smooth and hypoallergenic.

DETAILED DESCRIPTION OF THE PREFERRED EMBODIMENTS

Figure 1:
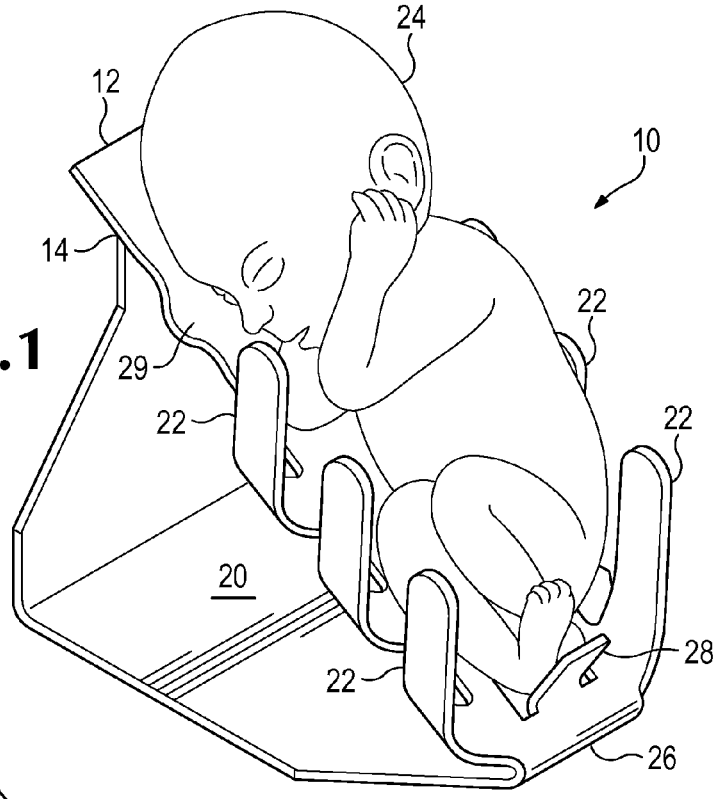
FIG. 1 is a perspective view of an infant support, according to the present invention, being used supporting an infant, according the method of the present invention.
Figure 2:
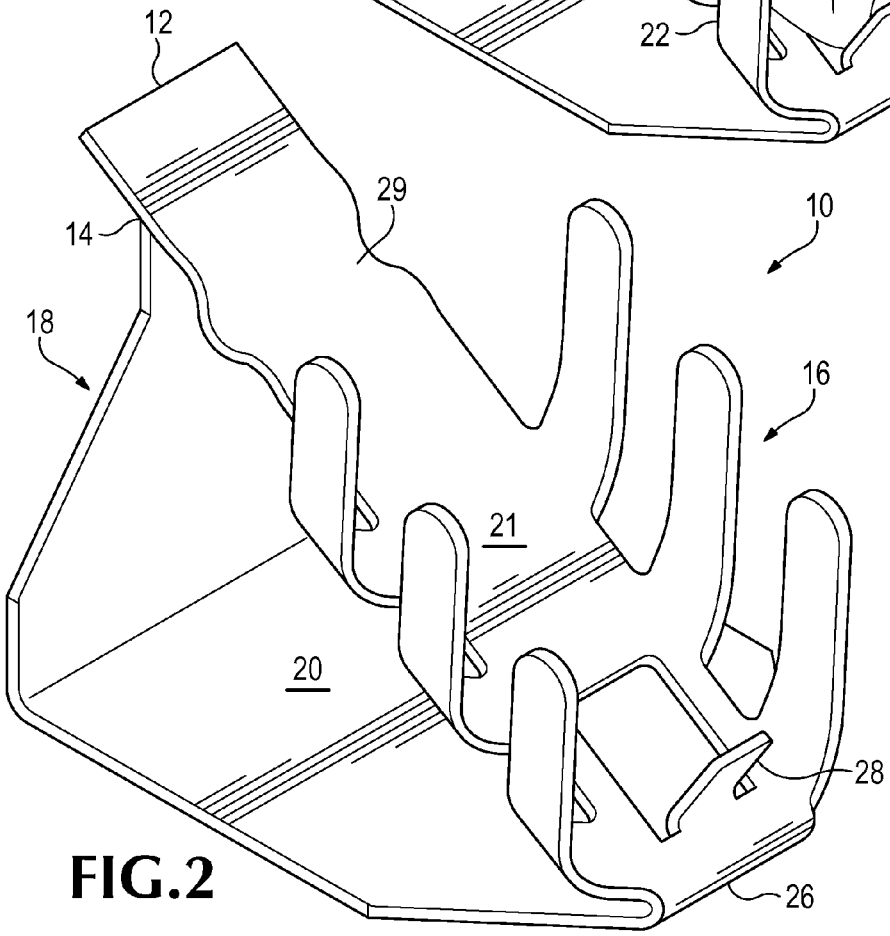
FIG. 2 is a perspective view of the infant support of FIG. 1, shown without the infant.
Figures 3, 4:
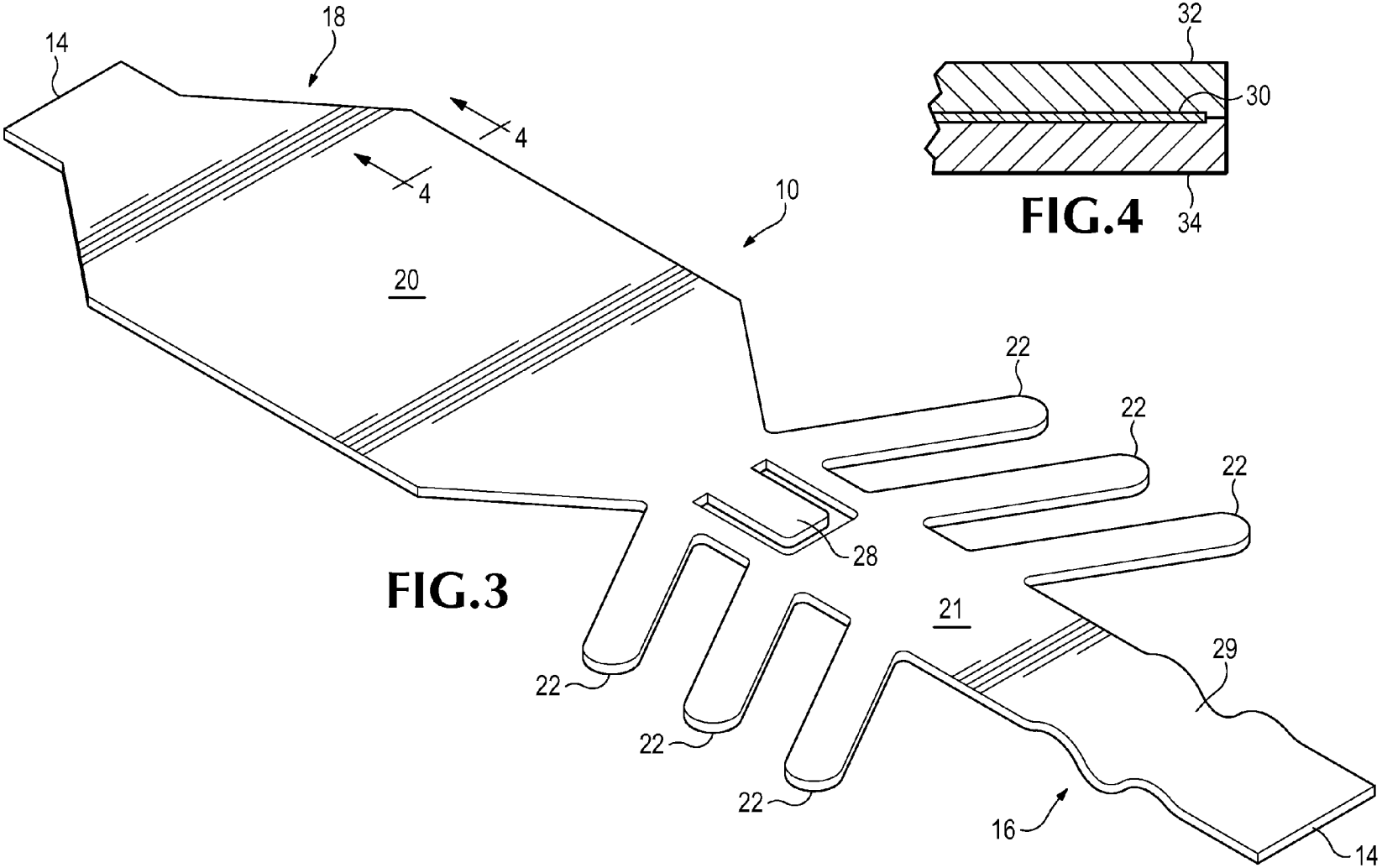
FIG. 3 is a perspective view of the infant support of FIG. 1, shown in unfolded form.
FIG. 4 is a sectional view of the infant support of FIG. 1, taken along line 4-4 of FIG. 3.

Referring to FIGS. 1-3, an infant support 10, is made of a piece of soft material (discussed further below) that is transversely resiliently deformable, but is also capable of being bent into and holding a shape. A first 12 and a second end 14 of support 10 are opposed to each other. Referring to FIGS. 1 and 2, support 10 can be bent into a vertical triangle, with an infant holding portion 16, proximal to first end 12, being supported by vertical portion 18. Portion 16 is connected to portion 18 by a medial portion 20, which serves as a base, when support 10 is in use. Portion 18 is distinguished from base 20 by a bend 19. Portion 16 includes an infant supporting platform 21 and a set of fingers 22, which project outwardly from the sides of a lower portion of platform 21. In use, fingers 22 are bent upwards to provide side-support to an infant 24. When support 10 is in this deployed configuration infant holding portion 16 has a top that is coincident with the first end 12 of support 10 and a bottom 26 at its juncture with segment 18.

Although in FIGS. 1 and 2 platform 21 is shown at approximately a 30° upward tilt, bend 19 could be formed nearer to or further from end 14 to create a shallower or a steeper slope for platform 21. In one configuration bend 19 is not formed and platform 21 is horizontal. Also, fingers 22 can be curled up around infant 24 to affirmatively secure the infant.

An infant support tab 28 is formed by a cut in platform 21. FIG. 1 shows tab 28 in use as intended, supporting an infant from sliding down the diagonally oriented infant platform 21. In an alternative preferred embodiment a tab, like tab 28, is formed by attaching a small sheet of material to platform 21. Alternatively, tab 28 could be omitted with the function of supporting the baby provided by a finger that is bent inwardly to the correct supporting position. A scallop 29, for permitting tubes and insulated wires to pass under the neck of infant 24, is formed between 4 and 7 cm from top 12 of platform 21.

Referring to FIG. 4, support 10 is made from a material having a center ductile sheet 30 covered with an infant-side layer 32 of infant compatible soft, foam material, and an outside layer 34 of a flexible foam material. Preferably the core sheet 30 is of nearly pure aluminum such as an Aluminum Association Type 1XXX aluminum, and preferably Type 1145 aluminum sheet material (99.45% pure) having a thickness in the range of 0.2 mm (0.008 inch) to 2 mm (0.079 inch), and preferably having a thickness of about 1.29 mm. (0.0508 inch). Preferably the metal is annealed to a dead soft or "0" temper. Bending the aluminum core 30 during the process of adjusting the support 10 to conform to a desired shape increases the rigidity (i.e. stiffness) of the support. Although aluminum is a natural candidate for the ductile core sheet 30, other ductile materials could be used. Other metals, such as iron and nickel are malleable and it is possible that a sheet of stainless steel having a thickness of less than a millimeter, could possess the required bending and shape-holding to meet the definition of "ductile material" set forth in this application. Other materials, such as a tightly-woven fiberglass or carbon-fiber mat or various composites and foams, may also be able to meet this definition.

The infant-side layer 32 of padding material has a thickness of about 6 mm (¼ in), although other thicknesses may be used. Layer 32 should also be somewhat resiliently compressible and porous and is therefore made of open-cell polymeric foam, such as a polyurethane foam, with an applied layer of flexible pressure sensitive adhesive. An acceptable density for such foam material is 0.5-4.0 lbs. per cubic foot, with 0.75 lbs.-3.0 lbs. per cubic foot being preferred. An indentation load deflection of about 25 is preferred, but any value up to 40 is acceptable, to provide sufficient firmness yet be comfortable. The open-cell construction of the infant-side layer 32 of padding material allows sufficient circulation of air, to cool and to dissipate any moisture from the skin of an infant using the support 10, to provide comfort and safe conditions for the infant. One acceptable material for the infant-side layer 32 is available from Foamex, of Compton, Calif., as its Foam Grade F 145 44 F.6 FA 44145-304.

In an alternative preferred embodiment support 10 includes a fabric covering made of a soft and absorbent or moisture-wicking fabric with a significant amount of elasticity to accommodate differing bending transformations of support 10. For example, a brushed terrycloth or boucle fleece of 65 percent polyester and 35 percent rayon fiber of 100 denier yarn, available from Eclat Textile Co. Ltd. of City of Industry, Calif. as its product number 1206D performs well for absorbing moisture and exudate from an infant's skin. Preferably, such a cloth is a low loop, tightly knitted material, brushed to provide a soft and slightly matted surface which is absorbent and not abrasive, so that support 10 can be used comfortably in direct contact with the infant's skin.

The outside layer 34 of padding material has a thickness preferably in the range of 2 mm inch to 7 mm. The layer 34 of padding material should be of a somewhat resiliently compressible or elastomeric material, and may be of a polymeric foam such as a closed cell microcellular low density expanded polyethylene available from Voltek Division of Sakisui American Corporation as its Volara Type A foam. Such foam material used as layer 34 preferably has a density of at least about 1.0 lbs. per cubic foot and preferably at least 2.0 lbs. per cubic foot. In an alternative preferred embodiment, outside layer 34 is a infant-compatible polymeric sheet, as opposed to a foam. Skilled persons will be familiar with a wide range of infant compatible polymers. In a further alternative layer 32 is a polymeric sheet with layers 32 and 34 sealed together about the sheet. In yet another preferred embodiment an outer seal of silicone or other adhesive is provided.

In an alternative preferred embodiment, medial segment 20 and vertical segment 18 are made of a different material from infant holding portion 16. For example these portions could be provided with a 90 degree angle already in place between portion 18 and 20, which could be made of a semi-rigid polymer sheet. In another preferred embodiment device 10 is provided already formed into a triangle, but with fingers 22 still extending to the side. In yet another preferred embodiment, fingers, similar to fingers 22 are attached to platform 21. This alternative permits a different material, having different material properties, to be used for the fingers than for platform 21.

It is most important that portion 16 be shaped into a form adapted to support a particular infant, although in some situations it will be important that the tilt of portion 16 be adjustable.

The above described embodiment of an infant support 10 answers all the issues noted in the Background section. It is shaped loosely like a human hand and can be deformed to cuddle and hold the baby in a wide variety of natural and developmentally correct poses. The design allows for elevating or lowering the baby's body; for inclining or declining it; even for rotating it axially. The fingers 22 can be wrapped around the baby, keeping it securely in one position. The fingers have spaces between them, and can be further moved by the user, to accommodate tubes, wires and devices. Also, tubes and wires can be secured to the device creating a strain relief at that point. When it is necessary to adjust the baby's position, the tubing, wires and devices may remain attached to support 10 as the entire collection can be adjusted as a unit.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A method of supporting an infant, comprising:

(a) providing an infant holding device, said device including an infant holding central portion sized to receive said infant and defining a longitudinal dimension and a transverse dimension and a plurality of elongated fingers extending outwardly in said transverse dimension from said central holding portion, said central holding portion and said elongated fingers comprised of a ductile sheet covered with infant-compatible material;

(b) applying force to said elongated fingers, and thereby deforming portions of said ductile sheet, to move said elongated fingers into a position adapted to retain said infant; and (c) placing said infant onto said infant holding device.

2. The method of claim 1, wherein said infant-compatible material is a polymeric foam.

3. The method of claim 1 wherein the plurality of elongated fingers includes at least four fingers.

4. The method of claim 1, wherein said central holding portion has a head end adapted to support an infant head and said elongated fingers extend longitudinally toward said head end as well as transversely outwardly from said infant holding central portion.

5. The method of claim 1 wherein said ductile sheet is entirely covered by said infant compatible material.

6. The method of claim 1, wherein force is applied to said elongated fingers, thereby deforming portions of said ductile sheet, to move said elongated fingers into a position adapted to retain said infant, after placing said infant onto said infant holding device.

7. The method of claim 1, further including the step of placing said infant holding central portion into a vertically diagonal position, in said longitudinal dimension.

8. The method of claim 7, wherein said infant holding central portion defines a through-cut that defines a tab, said tab including and being partially formed of a portion of said ductile sheet, and including deforming said portion of said ductile sheet in said tab, by bending said tab up to support said infant from sliding down said vertically diagonal infant holding central portion.

9. The method of claim 1, wherein said infant compatible material includes a first infant compatible material, covering a first portion of said ductile sheet, and a second infant compatible material, different from said first infant compatible material, covering a second portion of said device.

* * * * *